US011469038B2

(12) United States Patent
Choi et al.

(10) Patent No.: US 11,469,038 B2
(45) Date of Patent: Oct. 11, 2022

(54) COIL ELECTRONIC COMPONENT

(71) Applicant: SAMSUNG ELECTRO-MECHANICS CO., LTD., Suwon-si (KR)

(72) Inventors: Kang Ryong Choi, Suwon-si (KR); Il Jin Park, Suwon-si (KR); Jung Wook Seo, Suwon-si (KR); Jong Ok Jeon, Suwon-si (KR); Won Sik Chong, Suwon-si (KR); Woo Jin Lee, Suwon-si (KR); Jung Young Cho, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 359 days.

(21) Appl. No.: 16/137,271

(22) Filed: Sep. 20, 2018

(65) Prior Publication Data

US 2019/0198237 A1 Jun. 27, 2019

(30) Foreign Application Priority Data

Dec. 22, 2017 (KR) ..... 10-2017-0178503

(51) Int. Cl.
*H01F 17/00* (2006.01)
*H01F 27/36* (2006.01)
(Continued)

(52) U.S. Cl.
CPC ..... *H01F 27/366* (2020.08); *H01F 17/0013* (2013.01); *H01F 27/255* (2013.01);
(Continued)

(58) Field of Classification Search
CPC .... H01F 17/0013; H01F 27/36; H01F 27/255; H01F 27/2804
See application file for complete search history.

(56) References Cited

U.S. PATENT DOCUMENTS

2016/0172098 A1* 6/2016 Jeong ..... H01F 27/365 336/90
2016/0189863 A1* 6/2016 Park ..... H01F 17/04 29/602.1
(Continued)

FOREIGN PATENT DOCUMENTS

JP S-58184710 A * 10/1983 ..... H01F 27/36
JP 2008-166455 A 7/2008
(Continued)

OTHER PUBLICATIONS

Japanese Office Action dated Feb. 5, 2019 issued in Japanese Patent Application No. 2018-180485 (with English translation).
(Continued)

*Primary Examiner* — Elvin G Enad
*Assistant Examiner* — Malcolm Barnes
(74) *Attorney, Agent, or Firm* — Morgan, Lewis & Bockius LLP

(57) ABSTRACT

A coil electronic component includes a magnetic body in which internal coil parts are embedded, and a metal shielding sheet disposed on at least one of an upper portion and a lower portion of the magnetic body in a thickness direction, in which permeability of the metal shielding sheet is 100 times or higher than permeability of magnetic metal powder contained in the magnetic body.

14 Claims, 3 Drawing Sheets

(51) Int. Cl.

| | |
|---|---|
| ***H01F 27/255*** | (2006.01) |
| ***H01F 27/28*** | (2006.01) |
| ***H01F 27/32*** | (2006.01) |
| ***H01F 41/02*** | (2006.01) |
| ***H01F 41/04*** | (2006.01) |
| ***H01F 27/29*** | (2006.01) |

(52) U.S. Cl.

CPC ..... *H01F 27/2804* (2013.01); *H01F 27/29* (2013.01); *H01F 27/32* (2013.01); *H01F 27/361* (2020.08); *H01F 27/363* (2020.08); *H01F 41/0233* (2013.01); *H01F 41/041* (2013.01); *H01F 2017/008* (2013.01); *H01F 2027/2809* (2013.01)

(56) References Cited

U.S. PATENT DOCUMENTS

| | | | | |
|---|---|---|---|---|
| 2016/0225512 | A1* | 8/2016 | Kim | H01F 17/04 |
| 2016/0240296 | A1* | 8/2016 | Kim | H01F 17/04 |
| 2016/0276096 | A1* | 9/2016 | Moon | H01F 27/2804 |
| 2016/0293316 | A1* | 10/2016 | Park | H01F 17/0013 |
| 2016/0343498 | A1* | 11/2016 | Lee | H01F 17/0013 |
| 2017/0256353 | A1* | 9/2017 | Park | H01F 17/04 |
| 2017/0330669 | A1* | 11/2017 | Tomonari | H01F 27/36 |
| 2018/0096783 | A1* | 4/2018 | Fukuda | H01F 17/04 |
| 2018/0308612 | A1* | 10/2018 | Park | H01F 27/32 |
| 2018/0366246 | A1 | 12/2018 | Park et al. | |

FOREIGN PATENT DOCUMENTS

| | | | | |
|---|---|---|---|---|
| JP | 2011-009445 | A | | 1/2011 |
| JP | 2013-055232 | A | | 3/2013 |
| JP | 2013055232 | A | * | 3/2013 |
| JP | 2016-515305 | A | | 5/2016 |
| JP | 2016-122836 | A | | 7/2016 |
| JP | 2017-528001 | A | | 9/2017 |
| JP | 2017-204545 | A | | 11/2017 |
| KR | 10-1630086 | B1 | | 6/2016 |
| KR | 10-2017-0045113 | A | | 4/2017 |
| WO | 2014/164925 | A1 | | 10/2014 |
| WO | 2017/090950 | A1 | | 1/2017 |

OTHER PUBLICATIONS

Office Action issued in corresponding Korean Application No. 10-2017-0178503, dated Mar. 18, 2019.

* cited by examiner

COIL ELECTRONIC COMPONENT

CROSS-REFERENCE TO RELATED APPLICATION(S)

This application is based on and claims the benefit of priority to Korean Patent Application No. 10-2017-0178503 filed on Dec. 22, 2017 in the Korean Intellectual Property Office, the entire disclosure of which is incorporated herein by reference.

TECHNICAL FIELD

The present disclosure relates to a coil electronic component.

BACKGROUND

An inductor, a coil electronic component, is a representative passive element configuring an electronic circuit together with a resistor and a capacitor to remove noise.

The inductor is manufactured by forming internal coil parts in a magnetic body containing a magnetic material and then disposing external electrodes at an external surface of the magnetic body.

SUMMARY

An aspect of the present disclosure may provide a coil electronic component shielding radiation noise.

According to an aspect of the present disclosure, a coil electronic component may include: a magnetic body in which internal coil parts are embedded, and a metal shielding sheet disposed on at least one of an upper portion and a lower portion of the magnetic body in a thickness direction, wherein permeability of the metal shielding sheet is 100 times or higher than permeability of magnetic metal powder contained in the magnetic body.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Exemplary embodiments of the present disclosure will now be described in detail with reference to the accompanying drawings.

Hereinafter, a coil electronic component manufactured according to an exemplary embodiment in the present disclosure, particularly, a thin film type inductor will be described. However, the coil electronic component is not necessarily limited thereto.

Figure 1:
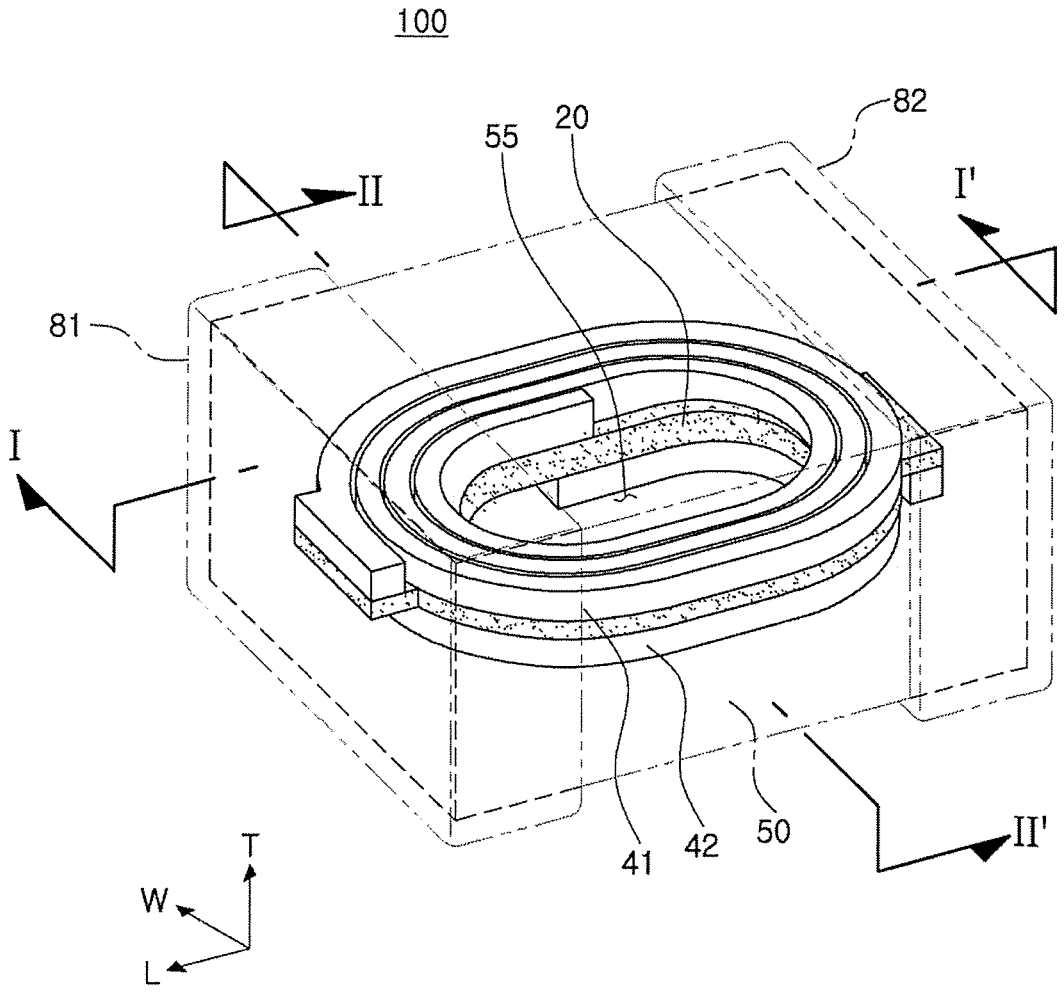
FIG. 1 is a schematic perspective view illustrating a coil electronic component manufactured according to an exemplary embodiment in the present disclosure so that internal coil parts of the coil electronic component are visible.

FIG. 1 is a schematic perspective view illustrating a coil electronic component manufactured according to an exemplary embodiment in the present disclosure so that internal coil parts of the coil electronic component are visible.

Referring to FIG. 1, as an example of a coil electronic component, a thin film type inductor used in a power line of a power supply circuit is disclosed.

A coil electronic component 100 according to an exemplary embodiment in the present disclosure may include a magnetic body 50, first and second internal coil parts 41 and 42 embedded in the magnetic body 50, and first and second external electrodes 81 and 82 disposed at an external surface of the magnetic body 50 and electrically connected to the first and second internal coil parts 41 and 42, respectively.

In the coil electronic component 100 according to the exemplary embodiment in the present disclosure, a length direction is denoted by an "L" direction of FIG. 1, a width direction is denoted by a "W" direction of FIG. 1, and a thickness direction is denoted by a "T" direction of FIG. 1.

In the coil electronic component 100 according to the exemplary embodiment in the present disclosure, a first internal coil part 41 having a planar coil shape is disposed on one surface of an insulating substrate 20, and a second internal coil part 42 having a planar coil shape is disposed on the other surface opposing the one surface of the insulating substrate 20.

The first and second internal coil parts 41 and 42 may be formed in a spiral shape, and the first and second internal coil parts 41 and 42 disposed on one surface and the other surface of the insulating substrate 20 may be electrically connected to each other through a via (not illustrated) penetrating through the insulating substrate 20.

A through hole is formed in a central portion of the insulating substrate 20 to penetrate through the central portion of the insulating substrate 20 and is filled with a magnetic material to form a core part 55. As the core part 55 filled with the magnetic material is formed, inductance (L) may be increased.

Further, since the insulating substrate 20 is formed by cutting to have a shape similar to that of the first and second internal coil parts 41 and 42, the magnetic body 50 may be maximally filled with a magnetic material, thereby implementing high inductance.

One end portion of the first internal coil part 41 disposed on one surface of the insulating substrate 20 may be exposed to one end surface of the magnetic body 50 in the length L direction, and one end portion of the second internal coil part 42 disposed on the other surface of the insulating substrate 20 may be exposed to the other end surface of the magnetic body 50 in the length L direction.

However, the first and second internal coil parts 41 and 42 are not necessarily limited thereto, and one end portion of each of the first and second internal coil parts 41 and 42 may be exposed to at least one surface of the magnetic body 50.

The first and second external electrodes 81 and 82 are disposed on the external surface of the magnetic body 50 to be electrically connected to the first and second internal coil parts 41 and 42 exposed to the end surfaces of the magnetic body 50, respectively.

Figure 2:
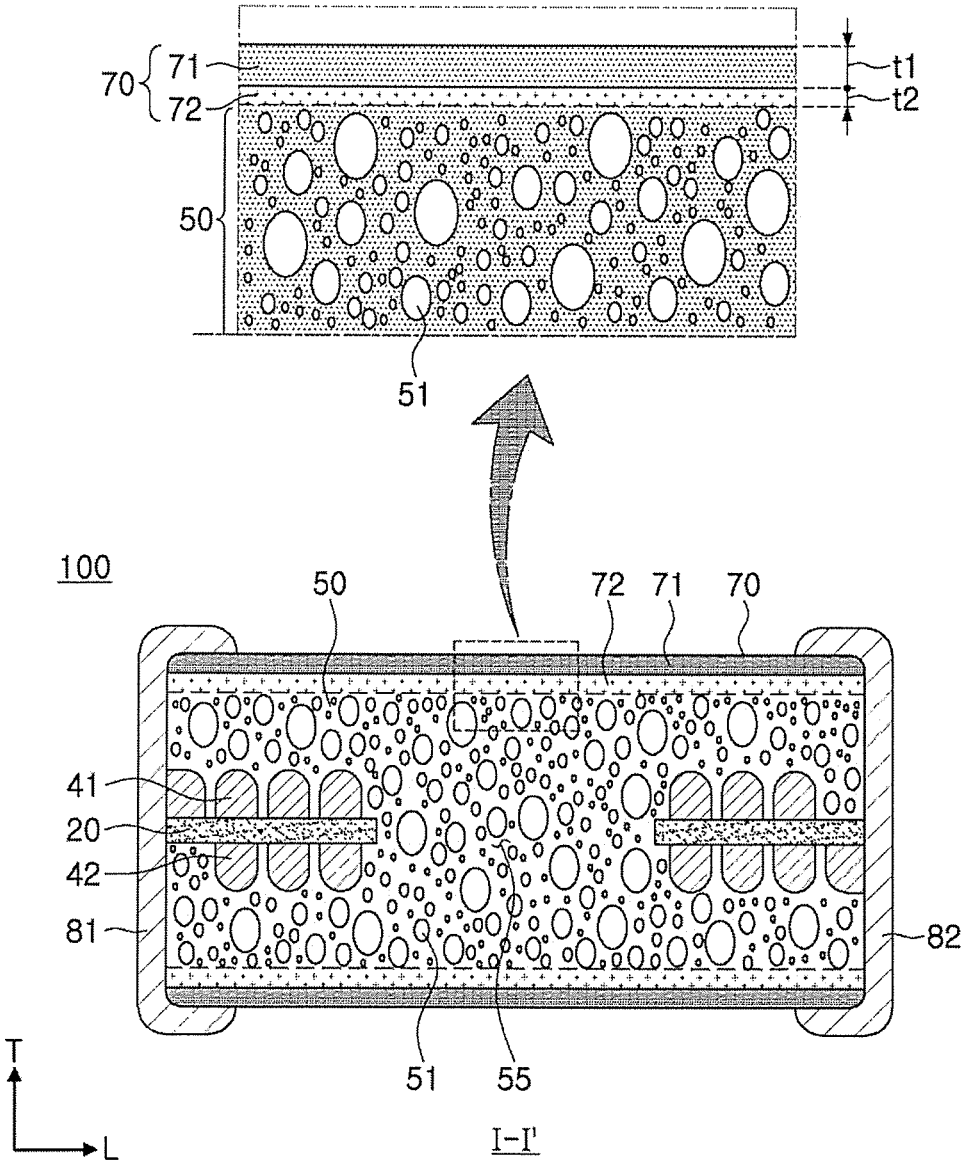
FIG. 2 is a cross-sectional view taken along line I-I' of FIG. 1.

FIG. 2 is a cross-sectional view taken along line I-I' of FIG. 1.

Referring to FIG. 2, the magnetic body 50 of the coil electronic component 100 manufactured according to the exemplary embodiment in the present disclosure contains magnetic metal powder 51. However, the magnetic body 50 is not necessarily limited thereto, and may contain any powder as long as it is magnetic powder exhibiting a magnetic property.

In the coil electronic component 100 manufactured according to the exemplary embodiment in the present disclosure, a cover part 70 including a metal shielding sheet 71 is disposed on at least one of an upper portion and a lower portion of the magnetic body 50 containing the magnetic metal powder 51.

The cover part 70 including the metal shielding sheet 71 has permeability higher than that of the magnetic body 50 containing the magnetic metal powder 51. In addition, the cover part 70 including the metal shielding sheet 71 may serve to prevent magnetic flux from leaking to the outside.

Accordingly, the coil electronic component 100 manufactured according to the exemplary embodiment in the present disclosure may implement high inductance and an excellent DC-bias characteristic and significantly reduce radiation noise.

Specifically, the permeability of the metal shielding sheet 71 may be 100 times or higher than that of the magnetic body 50 containing the magnetic metal powder 51.

Even in a case in which a metal sheet is disposed on at least one of an upper portion and a lower portion of a magnetic body according to the related art in order to prevent leakage of magnetic flux, the metal sheet merely has permeability 2 times or higher and 10 times or lower than permeability of the magnetic body.

However, according to an exemplary embodiment in the present disclosure, since the permeability of the metal shielding sheet 71 is 100 times or higher than that of the magnetic body 50 containing the magnetic metal powder 51, an effect of preventing magnetic flux from leaking to the outside is more excellent, such that radiation noise may be significantly reduced.

Particularly, according to another exemplary embodiment in the present disclosure, since the metal shielding sheet 71 may be disposed so that the permeability of the metal shielding sheet 71 may be 7500 times or higher than that of the magnetic body 50 containing the magnetic metal powder 51, an effect of significantly reducing radiation noise may be more excellent.

The magnetic metal powder 51 may be spherical powder or flake powder.

The magnetic metal powder 51 may be a crystalline or amorphous metal containing at least one selected from the group consisting of iron (Fe), silicon (Si), boron (B), chromium (Cr), aluminum (Al), copper (Cu), niobium (Nb), and nickel (Ni).

For example, the magnetic metal powder 51 may be an Fe—Si—B—Cr-based spherical amorphous metal.

The magnetic metal powder 51 is contained in a form in which it is dispersed in a thermosetting resin such as an epoxy resin or polyimide.

The metal shielding sheet 71 has permeability about 100 times or higher, more preferably, 7500 times or higher than that of the magnetic metal powder 51, and is disposed on the upper portion and the lower portion of the magnetic body 50, while having a plate shape, thereby preventing leakage of magnetic flux to the outside.

The metal shielding sheet 71 may be formed of a crystalline or amorphous metal containing at least one selected from the group consisting of iron (Fe), silicon (Si), boron (B), chromium (Cr), aluminum (Al), copper (Cu), niobium (Nb), and nickel (Ni).

The metal shielding sheet 71 according to the exemplary embodiment in the present disclosure may be in unpulverized metallic ribbon form.

According to the related art, the metal shielding sheet is pulverized to form a plurality of metallic pieces to be disposed, however, according to an exemplary embodiment in the present disclosure, the metal shielding sheet 71 may be disposed in the unpulverized metallic ribbon form to implement high permeability.

A thickness t1 of the metal shielding sheet 71 is not particularly limited, and may be, for example, 1 to 50 μm.

When the thickness of the metal shielding sheet 71 is less than 1 μm, the effect of significantly reducing radiation noise may be insufficient, and when the thickness of the metal shielding sheet 71 exceeds 50 μm, the sheet may be excessively thick, such that a volume of the body may be decreased by as much as the increased thickness. As a result, inductance may be decreased.

The cover part 70 further includes an insulating adhesive layer 72 disposed on at least one of an upper portion and a lower portion of the metal shielding sheet 71.

That is, the insulating adhesive layer 72 may be disposed between the magnetic body 50 and the metal shielding sheet 71.

The insulating adhesive layer 72 does not contain a thermosetting resin such as an epoxy resin or polyimide, unlike in the related art.

A thickness t2 of the insulating adhesive layer 72 is not particularly limited, and may be, for example, 3 to 100 μm.

Figure 3:
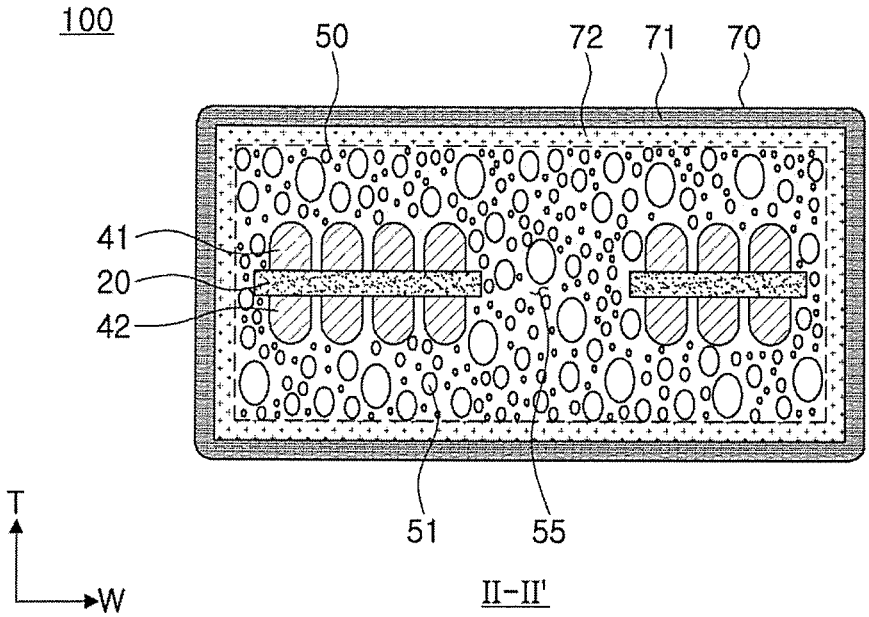
FIG. 3 is a cross-sectional view taken along line II-II' of FIG. 1.

FIG. 3 is a cross-sectional view taken along line II-II' of FIG. 1.

Referring to FIG. 3, according to another exemplary embodiment in the present disclosure, the metal shielding sheet 71 may be further disposed on at least one of both side surfaces of the magnetic body 50 in the width direction.

That is, according to still another exemplary embodiment in the present disclosure, the metal shielding sheet 71 may be disposed on both side surfaces of the magnetic body 50 in the width direction and the upper portion and the lower portion of the magnetic body 50.

As described above, as the metal shielding sheet 71 is disposed on both side surfaces of the magnetic body 50 in the width direction and the upper portion and the lower portion of the magnetic body 50, the effect of preventing magnetic flux from leaking to the outside is more excellent, such that radiation noise may be significantly reduced.

Figure 4:
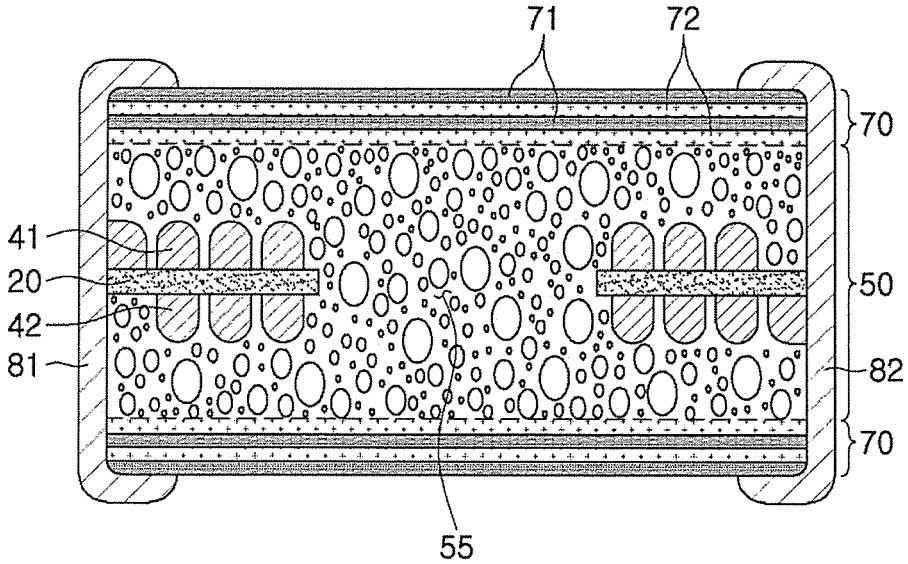
FIG. 4 is a cross-sectional view of a coil electronic component according to another exemplary embodiment in the present disclosure, taken along line I-I' of FIG. 1.

FIG. 4 is a cross-sectional view of a coil electronic component according to yet another exemplary embodiment in the present disclosure, taken along line I-I' of FIG. 1.

Referring to FIG. 4, the cover part 70 includes a plurality of metal shielding sheets 71 and a plurality of insulating adhesive layers 72.

The metal shielding sheet 71 and the insulating adhesive layer 72 may be alternately stacked.

The insulating adhesive layer 72 is disposed between the plurality of metal shielding sheets 71 to insulate adjacently stacked metal shielding sheets 71 from each other.

The cover part 70 includes the plurality of metal shielding sheets 71, thereby further improving permeability and securing higher inductance.

Since the metal shielding sheet 71 has permeability 100 times or higher, particularly, 7500 times or higher than that of the magnetic body 50, when about two layers of metal shielding sheets are disposed, radiation noise may be reduced. More preferably, three or more layers of metal shielding sheets 71 may be included.

According to an exemplary embodiment in the present disclosure, there is a difference in the effect of reducing radiation noise between Inventive Examples in which the metal shielding sheet 71 is included and Comparative Example in which a general inductor is manufactured without using the metal shielding sheet.

In detail, in Comparative Example in which the metal shielding sheet is not included, a radiation noise absorption rate was −33.06 dBm, whereas in Inventive Example 1 in which the metal shielding sheet 71 having permeability of 400 is included, a radiation noise absorption rate was −40.05 dBm, and in Inventive Example 2 in which the metal shielding sheet 71 having permeability of 15000 is included, a radiation noise absorption rate was −40.9 dBm.

That is, in comparison to the coil electronic component according to the related art, the coil electronic component 100 in which the metal shielding sheet 71 is disposed on the upper and lower portions of the magnetic body 50 according to the exemplary embodiment in the present disclosure has the effect of preventing magnetic flux from leaking to the outside, thereby significantly reducing radiation noise.

Hereinafter, a manufacturing process of the coil electronic component according to an exemplary embodiment in the present disclosure will be described.

First, the magnetic body 50 in which the internal coil parts 41 and 42 are embedded is formed. The magnetic body 50 contains the magnetic metal powder 51.

A method for forming the magnetic body 50 is not particularly limited, and any method may be used as long as it is possible to form a magnetic metal powder-resin composite in which an internal coil part is embedded.

Meanwhile, the magnetic body 50 may contain magnetic metal powder having a large average particle size and magnetic metal powder having a smaller average particle size than the magnetic metal powder having a large average particle size that are mixed with each other.

The magnetic metal powder having a large average particle size may implement higher permeability, and the magnetic metal powder having a smaller average particle size may improve a filling rate by being mixed with the magnetic metal powder having a large average particle size. As the filling rate is improved, the permeability may be further improved.

Further, when using the magnetic metal powder having a large average particle size, high permeability may be implemented, but core loss is increased, and the magnetic metal powder having a smaller average particle size is a low loss material. Therefore, by mixing the magnetic metal powder having a large average particle size and the magnetic metal powder having a smaller average particle size with each other, the core loss increased due to the use of the magnetic metal powder having a large average particle size may be complemented, and as a result, quality (Q) factor characteristics may be improved together.

Accordingly, the magnetic body 50 may contain the magnetic metal powder having a large average particle size and the magnetic metal powder having a smaller average particle size that are mixed with each other, thereby improving inductance and Q-factor characteristics.

However, there is a limitation in improvement of permeability when merely mixing the magnetic metal powder having a large average particle size and the magnetic metal powder having a smaller average particle size with each other.

According to the exemplary embodiment in the present disclosure, permeability may be further improved by further forming the metal shielding sheet 71.

Next, the cover part 70 including the metal shielding sheet 71 is disposed on the upper portion and the lower portion of the magnetic body 50.

The insulating adhesive layer 72 may be disposed between the magnetic body 50 and the metal shielding sheet 71, but the insulating adhesive layer 72 may also not be disposed. In this case, the magnetic body 50 and the cover part 70 including the metal shielding sheet 71 may be integrated with each other by compression and curing by using a laminating method or isostatic pressing method.

Meanwhile, a case in which the cover part 70 is formed by disposing the metal shielding sheet 71 on an uppermost portion and a lowermost portion of the magnetic body 50 is illustrated, the method for forming the cover part 70 is not necessarily limited thereto, and any method may be used as long as it is possible to implement the effect of the present disclosure by forming at least one layer of a metal shielding sheet within a range that may be used by those skilled in the art.

In addition, the cover part 70 including the metal shielding sheet 71 may also be disposed on a side surface of the magnetic body 50.

Meanwhile, the magnetic body 50 may be formed by, first, disposing the first and second internal coil parts 41 and 42 on one surface and the other surface of the insulating substrate 20.

The first and second internal coil parts 41 and 42 and a via (not illustrated) connecting the first and second internal coil parts 41 and 42 to each other may be formed by forming a via hole (not illustrated) in the insulating substrate 20, forming a plating resist having an opening on the insulating substrate 20, and then filling the via hole and the opening with a conductive metal by plating.

The first and second internal coil parts 41 and 42 and the via may be formed of a conductive metal having excellent electrical conductivity, for example, silver (Ag), palladium (Pd), aluminum (Al), nickel (Ni), titanium (Ti), gold (Au), copper (Cu), or platinum (Pt), or an alloy thereof.

However, the method for forming the first and second internal coil parts 41 and 42 is not necessarily limited to the plating as described above, but the internal coil parts may also be formed by using a metal wire.

An insulating film (not illustrated) coating the first and second internal coil parts 41 and 42 may be disposed on the first and second internal coil parts 41 and 42.

The insulating film (not illustrated) may be formed by a known method such as a screen printing method, a method using exposure and development of a photoresist (PR), a spray application method, or the like.

The first and second internal coil parts 41 and 42 may be coated with the insulating film (not illustrated) so as to not directly contact a magnetic material forming the magnetic body 50.

The insulating substrate 20 is formed by, for example, a polypropylene glycol (PPG) substrate, a ferrite substrate, a metal-based soft magnetic substrate, or the like.

In the insulating substrate 20, a central portion of a region in which the first and second internal coil parts 41 and 42 are not formed is removed to form the core part.

The removal in the insulating substrate 20 may be performed by mechanical drilling, laser drilling, sand blasting, punching, or the like.

Next, the magnetic sheet is staked above and below the first and second internal coil parts 41 and 42.

The magnetic sheet may be manufactured in a sheet form by mixing the magnetic metal powder 51, a thermosetting resin, and organic materials such as a binder, a solvent, or the like to prepare a slurry, applying the slurry to a carrier film at a thickness of several tens of μm using a doctor blade method, and then drying the slurry.

As the magnetic metal powder 51, spherical powder or flake powder may be used.

The magnetic sheet may be manufactured by mixing magnetic metal powder having a large average particle size and magnetic metal powder having a smaller average particle size than the magnetic metal powder having a large average particle size.

The magnetic sheet is manufactured in a form in which the magnetic metal powder 51 is dispersed in a thermosetting resin such as an epoxy resin or polyimide.

The magnetic body 50 in which the first and second internal coil parts 41 and 42 are embedded is formed by stacking, compressing, and curing the magnetic sheet.

At this time, the core part 55 is formed by filling the hole of the core part with a magnetic material.

Next, the cover part 70 is formed by alternately stacking the metal shielding sheet 71 and the insulating adhesive layer 72 on the magnetic body 50.

The metal shielding sheet 71 may be formed of a crystalline or amorphous metal containing at least one selected from the group consisting of iron (Fe), silicon (Si), boron (B), chromium (Cr), aluminum (Al), copper (Cu), niobium (Nb), and nickel (Ni).

The thickness t1 of the metal shielding sheet 71 may be 1 to 50 μm.

When the thickness t1 of the metal shielding sheet 71 is less than 1 μm, the effect of improving permeability and reducing leakage of magnetic flux may be decreased, and when the thickness t1 of the metal shielding sheet 71 exceeds 50 μm, inductance may be decreased due to decrease in a volume of the body and Q-factor characteristics may deteriorate due to increase in core loss.

The thickness t2 of the insulating adhesive layer 72 may be 3 to 100 μm.

When the thickness t2 of the insulating adhesive layer 72 is less than 3 μm, an insulation effect between adjacent metal shielding sheets 71 may be decreased, and when the thickness t2 of the insulating adhesive layer 72 exceeds 100 μm, the effect of improving permeability may be decreased.

The metal shielding sheet 71 may be formed of a crystalline or amorphous metal.

As set forth above, according to exemplary embodiments in the present disclosure, the coil electronic component significantly reducing radiation noise may be provided.

While exemplary embodiments have been shown and described above, it will be apparent to those skilled in the art that modifications and variations could be made without departing from the scope of the present invention as defined by the appended claims.

What is claimed is:

1. A coil electronic component, comprising:

a magnetic body in which internal coil parts are embedded; and a metal shielding sheet disposed on at least one of an upper portion or a lower portion of the magnetic body in a thickness direction, wherein permeability of the metal shielding sheet is 100 times or higher than permeability of the magnetic body containing magnetic metal powder, wherein the metal shielding sheet extends from the at least one of an upper portion or a lower portion of the magnetic body to cover at least one side surface of the magnetic body in a width direction, wherein the metal shielding sheet extends in the width direction from one edge of the at least one of an upper portion or a lower portion to another edge of the at least one of an upper portion or a lower portion, and wherein an insulating adhesive layer is disposed between the magnetic body and the metal shielding sheet.

2. The coil electronic component of claim 1, wherein the permeability of the metal shielding sheet is 7500 times or higher than permeability of the magnetic body containing the magnetic metal powder.

3. The coil electronic component of claim 1, wherein the metal shielding sheet is in unpulverized metallic ribbon form.

4. The coil electronic component of claim 1, wherein the insulating adhesive layer has a thickness of 3 to 100 μm.

5. The coil electronic component of claim 1, wherein the metal shielding sheet and the insulating adhesive layer are alternately stacked in the thickness direction.

6. The coil electronic component of claim 1, wherein the metal shielding sheet has a thickness of 1 to 50 μm.

7. The coil electronic component of claim 1, wherein the metal shielding sheet contains an amorphous or crystalline metal.

8. The coil electronic component of claim 1, wherein the metal shielding sheet is disposed on both side surfaces of the magnetic body in the width direction.

9. The coil electronic component of claim 8, wherein the metal shielding sheet is disposed on the upper and lower portions of the magnetic body in the thickness direction.

10. The coil electronic component of claim 1, wherein the metal shielding sheet contains at least one selected from the group consisting of iron (Fe), silicon (Si), boron (B), chromium (Cr), aluminum (Al), copper (Cu), niobium (Nb), and nickel (Ni).

11. The coil electronic component of claim 1, wherein the internal coil parts include first and second internal coil parts each having an end portion exposed to at least one external surface of the magnetic body.

12. The coil electronic component of claim 11, further comprising first and second external electrodes each disposed at the at least one external surface of the magnetic body and electrically connected to the first and second internal coil parts, respectively.

13. The coil electronic component of claim 12, wherein each of the first and second external electrodes includes a bending portion extending from a circumference thereof to cover portions of the upper and lower portions of the magnetic body in the thickness direction and portions of both side surfaces of the magnetic body in a width direction.

14. The coil electronic component of claim 13, wherein the bending portion of each of the first and second external electrodes extends in a length direction to cover an outer portion of the metal shielding sheet.

* * * * *